US005669200A

United States Patent [19]

Disrud

[11] Patent Number: 5,669,200

[45] Date of Patent: Sep. 23, 1997

[54] AUTOMATIC DUAL POCKET LOADER WHEEL ASSEMBLY

[75] Inventor: Jeff Disrud, Marietta, Ga.

[73] Assignee: Riverwood International Corporation, Atlanta, Ga.

[21] Appl. No.: 650,124

[22] Filed: Jun. 7, 1996

[51] Int. Cl.[6] ..... B65B 35/26

[52] U.S. Cl. ..... 53/201; 53/244; 53/247; 53/250; 53/251

[58] Field of Search ..... 53/201, 48.1, 543, 53/566, 244, 247, 249, 250, 251

[56] References Cited

U.S. PATENT DOCUMENTS

| | | | |
|---|---|---|---|
| 2,756,553 | 6/1956 | Ferguson et al. | 53/48.1 |
| 2,885,841 | 5/1959 | Currie et al. | 53/543 X |
| 4,237,673 | 12/1980 | Calvert et al. | 53/251 X |
| 5,237,795 | 8/1993 | Cheney et al. | 53/566 X |
| 5,502,950 | 4/1996 | Moncrief et al. | 53/566 X |
| 5,546,734 | 8/1996 | Moncrief et al. | 53/566 X |

*Primary Examiner*—Daniel Moon

[57] ABSTRACT

A dual pocket loader wheel assembly for use on a continuous motion packaging machine is disclosed. The dual pocket loader wheel assembly has an elongate tubular member supported for rotation on a framework positioned on the packaging machine with respect to a carton transport conveyor on the packaging machine. A drive frame is positioned at one end of the tubular member and rotatably supports a spaced pair of pocket loader wheels thereon. A drive motor assembly is positioned on the framework at the other end of the tubular member and is operably connected to a drive shaft extending through the tubular member and into the drive frame for rotating the dual pocket loader wheels about their axes. The loader wheel assembly includes a rotary actuator mounted on the framework and operably engaged with the tubular member for rotating the tubular member to reverse the position of the dual pocket loader wheels with respect to the carton transport conveyor. The loader wheel assembly also includes a double action cylinder for moving the framework toward and away from the carton transport conveyor for positioning each pocket loader wheel, respectively, adjacent the carton transport conveyor to seat articles placed within preformed cartons being moved on the carton transport conveyor adjacent, and past, the dual pocket loader wheel assembly. Each pocket loader wheel is sized and shaped to engage the flaps at the open end of the carton and to fold the flaps into a closed position on the open end of the carton as it passes thereby.

12 Claims, 7 Drawing Sheets

AUTOMATIC DUAL POCKET LOADER WHEEL ASSEMBLY

FIELD OF THE INVENTION

This invention relates in general to packaging machinery and to methods of packaging articles into containers. More particularly, this invention relates to continuous motion end loading packaging machines which form groups of articles into predetermined group sizes and configurations and use a loader wheel assembly to seat the articles within preformed cartons or packages constructed of paperboard moving along a path of travel on the packaging machine.

BACKGROUND OF THE INVENTION

Continuous motion packaging machines are known in the art. Continuous motion packaging machines, including end loading machines, typically group a selected number of articles, for example beverage containers, into a desired configuration, the articles then being packaged in a carton or paperboard carrier. When packaging beverages, for example, the articles are grouped into a predetermined configuration or pattern, and either moved singularly or as a group through the open end, or ends, of a preformed carton being moved along a path of travel on the packaging machine.

In end loading continuous motion packaging machines, a supply of articles is positioned on an infeed conveyor and moved toward and into a selector assembly, or other selecting device, which forms the articles into groups of articles of a predetermined size. As the articles are moved along the packaging machine, paperboard carton blanks are being moved in timed relationship with the movement of the articles and are opened into preformed cartons having at least one open end facing toward the group of articles. Thereafter, the articles are guided into the open end, or ends, of the carton whereupon the articles are seated by a loader or seating wheel assembly within the carton, and the flaps at the open end(s) of the carton are folded over and glued shut.

One example of a continuous motion packaging using loader wheels is disclosed in U.S. Pat. No. 5,241,806 to Ziegler et at., issued Sep. 7, 1993. In Ziegler et al., groups of articles are moved into an open end of a carton being carried on a carton transport conveyor, with a pair of flap tuckers disposed adjacent each side of the carton transport conveyor, one opposite the loading region of the carton to provide a closed carton backside against which the carton may rest, and the other flap tucker wheel being provided for closing the flaps on the open end of the carton once it has been filled with the articles. Both of the flap tucker wheels shown in Ziegler et al., however, are of a predetermined shape and size for a specific carton size and article configuration, and are fixed in position along the length of the carton transport conveyor of the packaging machine. It does not therefore appear that the packaging machine of Ziegler et al. allows for that degree of flexibility needed for packaging several sizes of cartons on the same machine.

Another example of a continuous motion packaging machine having article seating wheels is disclosed in U.S. Pat. No. 5,237,795 to Cheney et al., issued Aug. 24, 1993. In Cheney et al. a pair of cam seating wheels are positioned opposite one another adjacent the spaced open ends of a carton through which articles have been passed. The seating wheels clear the leading and trailing carton flaps and seat the articles within the carton without disturbing the flaps. The carton is then passed through a pair of spaced and opposed rotary tucker wheels for closing the carton flaps on the two open ends of the carton as the carton is moved along the path of travel on the packaging machine. Again, and as with the flap tucker wheels of Ziegler et al., the seating wheels of Cheney et al. are of a predetermined shape and size for a predetermined carton size, and are fixed in position with respect to one another on the packaging machine.

Similar seating wheels are disclosed in U.S. Pat. No. 4,693,055 to Olson, Jr. et al., in U.S. Pat. No. 4,237,673 to Calvert et al., and in U.S. Pat. No. 2,756,553 to Ferguson et al. In each of these patents, a pair of spaced seating wheels is positioned along the path of travel downstream of the carton loading station so that the articles are seated within the carton, from both ends, whereupon the carton flaps are sealed either by the seating wheels themselves, as shown in Olson, Jr. et al., or by a pair of flap folding wheels provided on opposite sides of the travel as shown in Ferguson et al.

What none of the aforementioned patents provide, however, is a seating mechanism which is readily adapted for use with groups of articles of a variety of predetermined group sizes on the same packaging machine without having to stop the machine and physically change the components thereof. Use of the packaging machines described above oftentimes results in a packaging plant having several packaging machines, each one set for a certain size article, and/or a certain predetermined group (carton) size.

What has been needed is a continuous motion packaging machine which can be readily adapted for use with articles of varying sizes, as well as for processing groups of articles of more than one predetermined group size on the same machine. What is thus needed, but seemingly unavailable in the art, is a packaging machine loader wheel assembly which can be automatically adjusted for processing a variety of different predetermined group sizes of articles for loading a variety of articles and predetermined group sizes of articles without the need to stop the packaging machine, disassemble components, and reassemble different components prior to resuming packaging operations.

SUMMARY OF THE INVENTION

The present invention comprises a highly flexible pocket loader wheel assembly in terms of its ability to seat a variety of predetermined group sizes or packaging configurations. In order to attain this high degree of flexibility, the present invention includes an automatic dual pocket loader wheel assembly positioned on a packaging machine with respect to a carton transport conveyor positioned on the packaging machine, on which preformed cartons having at least one open end are moved and into which predetermined group sizes of articles are placed upstream of the loader wheel assembly. The loader wheel assembly comes into engagement with the articles through the open end of the carton, seats the articles therein, and closes the flaps on the open end of the carton as the carton moves along a path of travel on the packaging machine.

The novel dual pocket loader wheel assembly of this invention includes an elongate tubular member extending along a longitudinal axis, the tubular member having a first end and spaced second end. The tubular member is supported for rotation on a framework, the framework being positioned on the packaging machine with respect to the carton transport conveyor. A drive frame assembly is mounted on the second end of the tubular member, the drive frame assembly supporting a first pocket loader wheel and spaced second pocket loader wheel, each of the pocket loader wheels being rotatably supported on the drive frame assembly. The loader wheel assembly includes a drive motor, which can be, for example, an AC motor, a DC motor, or a servomotor, mounted on the framework at the first end of the tubular member for rotating each of the pocket loader wheels in the direction of the path of travel, the drive frame assembly being constructed and arranged to alternately position the first pocket loader wheel and the second pocket loader wheel adjacent the carton transport conveyor.

The dual pocket loader wheel assembly also includes a rotary actuator supported on the framework for rotating the tubular member about its longitudinal axis to reverse the positions of the pocket loader wheels adjacent the carton transport conveyor. The loader wheel assembly also includes a double action cylinder, either a hydraulic or a pneumatic cylinder, mounted on the framework of the loader wheel assembly and engaged with the packaging machine. The framework is supported on a pair of linear bearing assemblies so that as the double action cylinder is actuated, the framework of the loader wheel assembly is moved toward and away from the carton transport conveyor prior to and during the rotation of the tubular member for alternately positioning the first pocket loader wheel, and second pocket loader wheel, respectively, adjacent the carton transport conveyor.

The pocket loader wheels are each sized and shaped to seat predetermined groups of articles within preformed cartons passed along the path of travel on the carton transport conveyor. The first pocket loader wheel is sized to handle predetermined groups of articles which fit within the "split" pockets of the transport conveyor so that the pockets or flights of the carton transport conveyor are split into flights of 7½ inch centers for packaging smaller predetermined group sizes of articles, for example, six packs and four packs. The second pocket loader wheel is sized and shaped for handling larger predetermined group sizes, for example case lots and half case lots on 15 inch centers.

Each pocket loader wheel, therefore, has a spaced series of pockets defined along is periphery for receiving one of the flaps at the open end of the carton for folding the flap into a closed position on the open end of the carton as the carton passes by the pocket loader wheel assembly. Both pocket loader wheels are also sized and shaped to engage the other flap at the open end of the carton for moving that flap into a closed position on the carton also.

The method practiced by this invention includes the steps of positioning the dual pocket wheel loader assembly on the packaging machine with respect to the carton transport conveyor, and then positioning one of the pocket loader wheels adjacent the carton transport conveyor. Thereafter, the pocket loader wheel assembly is moved away from the carton transport conveyor so that the pocket loader wheel is no longer adjacent the carton transport conveyor, the elongate member of the pocket loader wheel assembly is rotated to reverse the positions of the pocket loader wheels so that the other of the pocket loader wheels is now extending toward the carton transport conveyor, the pocket loader wheel assembly being moved toward the carton transport conveyor to place the other of the pocket loader wheels adjacent the carton transport conveyor.

The structure of this invention, therefore, and the method practiced by this invention results in a dual pocket loader wheel assembly for use on continuous motion packaging machines which is highly flexible, and allows a single machine to be readily utilized to package a variety of different articles, and to package a variety of predetermined group sizes of articles. Accordingly, the objects of the present invention include the ability to readily convert the machine to process articles of differing sizes, the ability to readily alter the configuration of the articles, i.e., the predetermined group sizes of the articles, and to permit various carton sizes to be readily used. The present invention accomplishes the above-stated objects by providing for efficient, continuous, high-speed article packaging on a single continuous motion packaging machine.

DETAILED DESCRIPTION OF THE PREFERRED EMBODIMENT

Figure 1:
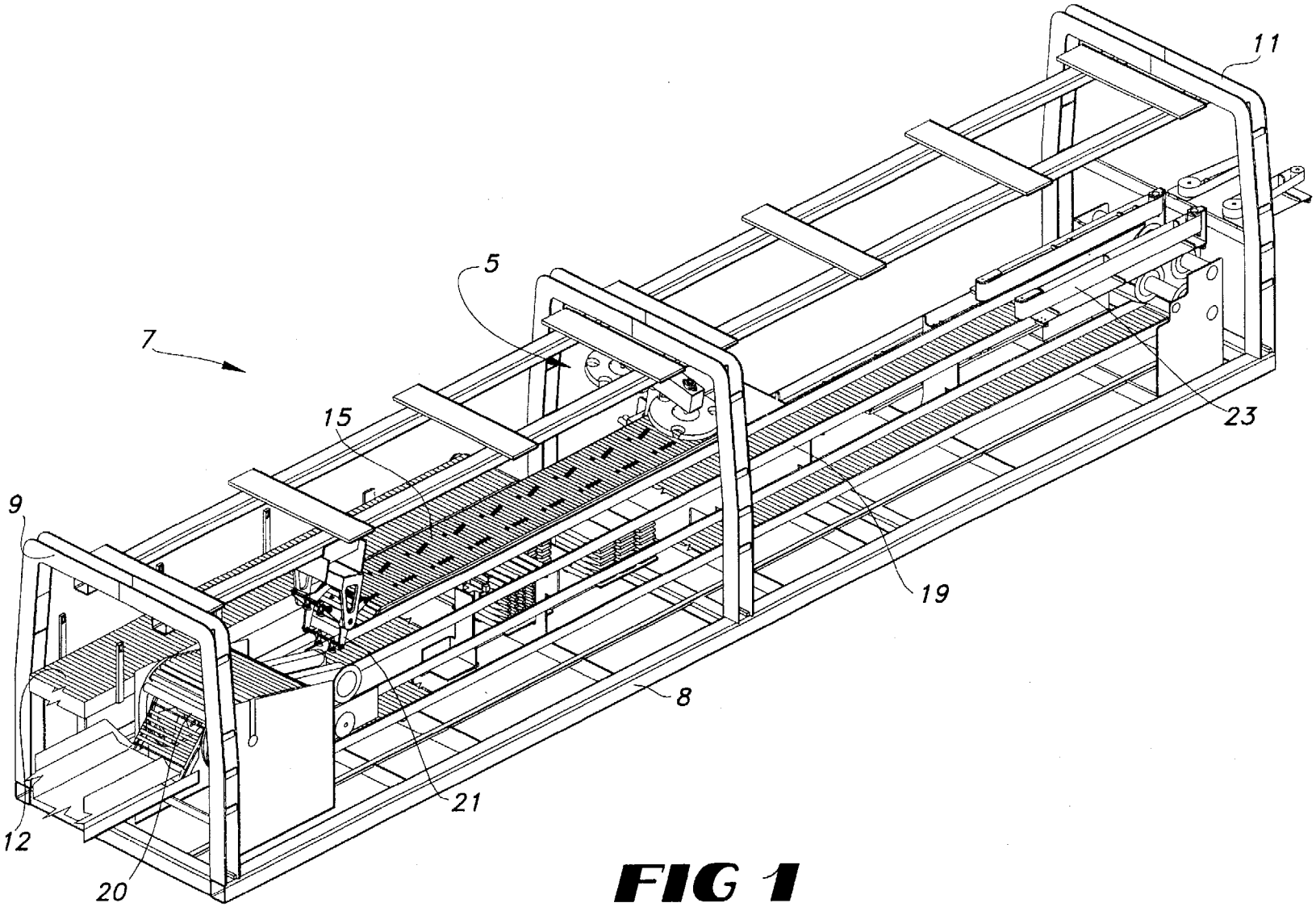
FIG. 1 is a perspective view of a continuous motion packaging machine with a preferred embodiment of the dual pocket loader wheel assembly positioned thereon.
Figure 2:
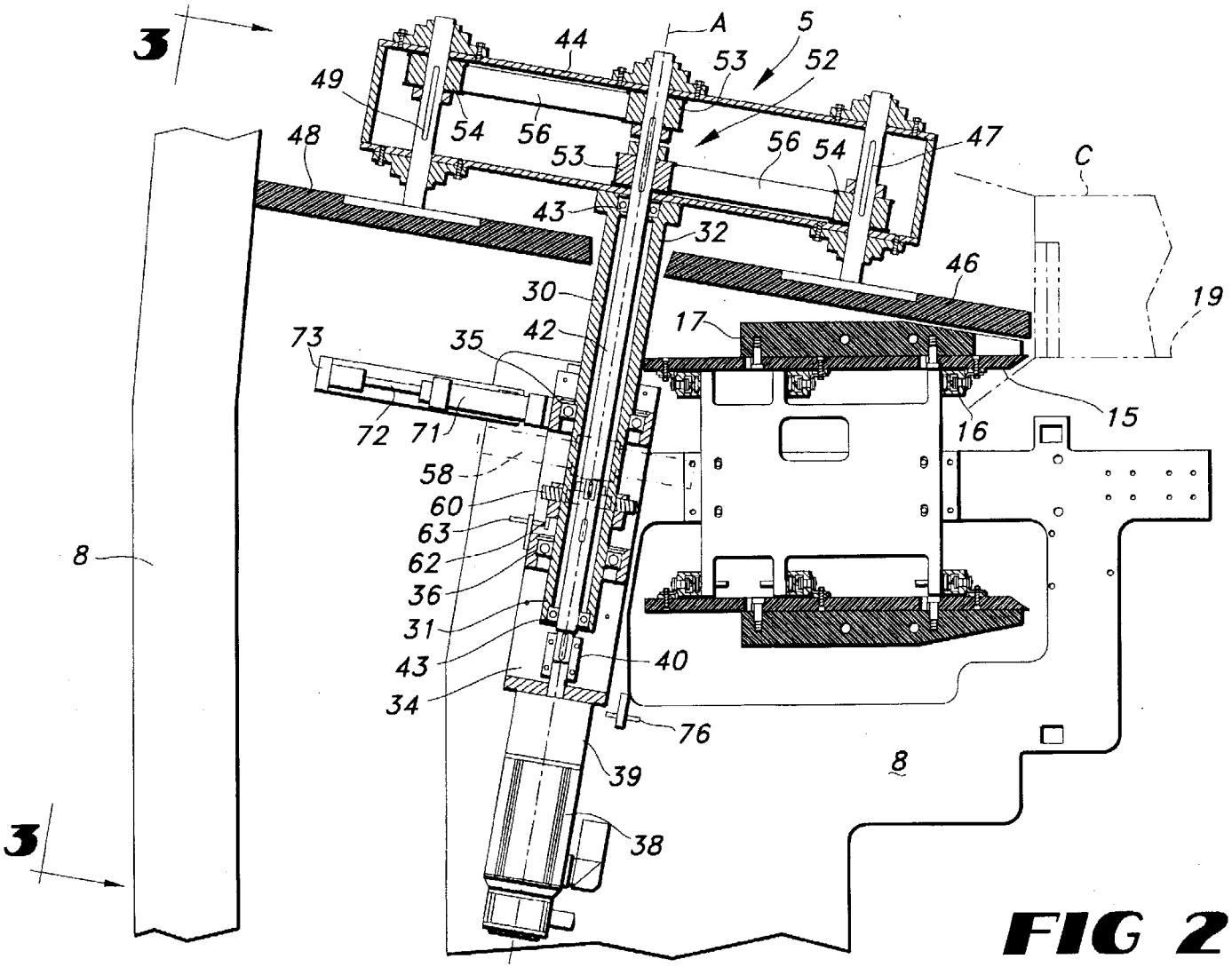
FIG. 2 is a partially cross-sectioned elevational view of the dual pocket loader wheel assembly of FIG. 1 positioned adjacent the carton transport conveyor of the packaging machine.

Referring now to the drawings, in which like reference numerals indicate like parts throughout the several views, numeral 5 of FIG. 1 shows a preferred embodiment of the dual pocket loader wheel assembly of this invention positioned on a continuous motion packaging machine 7. Packaging machine 7 as shown in FIG. 1 is a continuous motion packaging machine having a walk-in frame 8 extending along the length of the packaging machine. Packaging machine 7 includes an infeed end 9, a spaced discharge end 11, and a randomly ordered supply of articles (not illustrated) being received at infeed end 9 on infeed conveyor 12 and being moved through a series of spaced guides 13 (FIGS. 4A–4D) onto a selector belt 15. Selector belt 15, as shown in FIG. 2, is powered by parallel chain conveyors 16 and has a spaced series of selector wedges 17 removably attached thereto.

Returning now to FIG. 1, packaging machine 7 further includes a carton transport conveyor 19 for moving preformed cartons (not illustrated) along a path of travel from the infeed end toward the discharge end of the packaging machine. Carton transport conveyor 19 is supported on frame 8 parallel to and adjacent at least a portion of the length of selector belt 15. Positioned upstream of carton transport conveyor 19, at infeed end 9 of the packaging machine, is a carton magazine assembly 20 having a plurality of unopened carton blanks (not illustrated) stored thereon, the unopened carton blanks being formed into opened, i.e., preformed cartons, at carton opening station 21 positioned intermediate carton magazine assembly 20 and carton transport conveyor 19.

The randomly ordered articles (not illustrated) carried on infeed conveyor 12 are formed into lanes of article (not illustrated) by guide assembly 13, and received on selector belt 15, whereupon selector belt wedges 17 form the articles into groups of articles of a predetermined group size. The method and apparatus of so forming the articles into groups of articles of a predetermined group size is more fully disclosed in application Ser. No. 08/118,111, now U.S. Pat. No. 5,546,734 filed on Sep. 2, 1993, and pending in the U.S. Patent & Trademark Office, and incorporated by reference as is set forth fully herein.

As the article are being formed into groups of a predetermined size, the unopened carton blanks (not illustrated) positioned on carton magazine assembly 20 are passed to carton opening station 21, whereupon the cartons are opened and then transferred to carton transport conveyor 19. Thereafter, the now opened cartons are moved on carton transport conveyor 19 at substantially the same speed and in substantially the same direction, i.e., along the path of travel, as are the articles being moved on selector belt 15 so that in combination with the guide rails and selector wedges, groups of articles are sequentially moved into the open ends (not illustrated) of the preformed cartons being moved on transport conveyor 19 adjacent selector belt 15. The now filled but still open ended cartons proceed along the carton transport conveyor to dual pocket loader wheel assembly 5, positioned on frame 8 downstream of selector belt 15, whereupon the dual pocket loader wheel assembly seats the articles within the cartons, engaging the articles through the open ends of the cartons. The end of the carton opposite its open end (not illustrated) is generally supported by a guide rail (not illustrated) or other support device formed as a part of the carton transport conveyor and/or the packaging machine.

A preferred embodiment of dual pocket loader wheel assembly 5 is illustrated in greater detail in FIG. 2. Dual pocket loader wheel assembly 5 is shown in FIGS. 2 positioned on frame 8 of packaging machine 7. As shown in FIG. 1 and 2, frame 8 is a walk-in frame of the type used in the QUICKFLEX family of packaging machines manufactured by Riverwood International Corporation of Atlanta, Ga. Still referring to FIG. 2, dual pocket loader wheel assembly 5 has an elongate tubular member 30 extending along a longitudinal axis "A" and has a first end 31 and a spaced second end 32. Tubular member 30 is supported for rotation on a framework 34 by an upper bearing assembly 35, and a spaced lower bearing assembly 36, both of said bearing assemblies being positioned intermediate the first and second ends of the elongate tubular member.

Positioned on framework 34 at first end 31 of tubular member 30 is a drive motor 38 operably connected to a gear reducer 39. Drive motor 38 may be an A.C. motor or a D.C. motor, it is anticipated, however, that drive motor 38 will be a servomotor for precise control in rotating pocket loader wheels 46, 48. Gear reducer 39 is coupled via a coupling 40 to an elongate drive shaft 42 extending from the first end to the second end of the tubular member therewithin and along longitudinal axis A. Tubular member 30 is hollow, and sized and shaped so that it can receive drive shaft 42 therein without striking the inner wall of the tubular member. Drive shaft 42 is supported at the first and second ends, respectively, of tubular member 30 by a spaced pair of drive shaft bearing assemblies 43 so that drive shaft 42 freely rotates within tubular member 30 along longitudinal axis A.

Attached to the second end of tubular member 30 is a drive frame 44 constructed to support the two pocket loader wheels of this invention. Thus, and as shown in FIG. 2, as well as in FIGS. 4A–4D, drive frame 44 supports a first pocket loader wheel 46 on a first axle 47, and a second pocket loader wheel 48 on a second axle 49, respectively. So constructed, each loader wheel 46 and 48 freely rotates about its axle on drive frame 44.

As best shown in FIGS. 4A–4D, each pocket loader wheel 46, 48 has a spaced series of pockets 50 defined therein along its circumference. First pocket loader wheel 46 is constructed for use in closing the open end flaps of a carton received on carton transport conveyor 19 where the flights, or pockets, of the carton transport conveyor are on 15 inch centers as disclosed in application Ser. No. 08/118,111, now U.S. Pat. No. 5,546,734 which equates to articles being packaged in full case and half case lots of 24 and 12 articles, respectively. Second pocket loader wheel 48 has twice as many pockets 50 as does first loader wheel 46 so that it can be used with carton transport conveyor 19 in its "split" pocket configuration, wherein twice as many cartons are moved along the carton transport conveyor, the cartons being on 7½ inch centers as opposed to 15 inch centers, for receiving cartons holding four articles or six articles in a "two-up" configuration to seat the articles within the carton, and then close the flaps on the open end of the carton. So constructed, first loader wheel 46 and second loader wheel 48 will engage the leading flap (not illustrated) at the open end (not illustrated) of a carton (not illustrated) along the periphery of the loader wheel as the carton moves along carton transport conveyor 19, and will fold the flap on the open end of the carton while catching the other flap (not illustrated) at the open end of the carton in pocket 50. Pocket loader wheels 46, 48 are each rotated in the direction of the path of travel along carton transport conveyor 19, denoted by the referenced character "P", by drive motor 38 at a speed greater than the speed of the cartons moving along carton transport conveyor 19 for thus closing the flap received within one of pockets 50 on the open end of the carton prior to passing the carton off to a downstream glue station (not illustrated) where the flaps are glued and the carton sealed shut.

Referring again to FIG. 2, each of loader wheels 46 and 48 is driven for rotation within drive frame 44 by drive belt assembly 52, the drive belt assembly being operably connected to drive shaft 42 extending through tubular member 30. Thus, drive belt assembly 52 includes a hub 53 received on the drive shaft for each pocket loader wheel, respectively, a pulley 54 received on each pocket loader wheel axle 47 and 49, respectively, with a separate drive belt 56 extending between each hub 53 and each pulley 54 so that both pocket loader wheels are rotated simultaneously. It is anticipated, although not illustrated herein, that a clutch system could be used for rotating only one of the pocket loader wheels adjacent carton transport conveyor 19 if so desired, or a separate drive motor, for example a servomotor, could be provided for each pocket loader wheel to individually rotate the pocket loader wheel when if so desired. As shown in FIG. 2, however, drive belt assembly 5 offers the advantage of simplicity and relatively low cost coupled with the relatively long service life of a simple drive mechanism. Although not shown in FIG. 2, it is anticipated that hubs 53, pulleys 54 and drive belts 56 will each be toothed for positive engagement, or could be a series of sprockets and drive chains if so desired.

Figure 3:
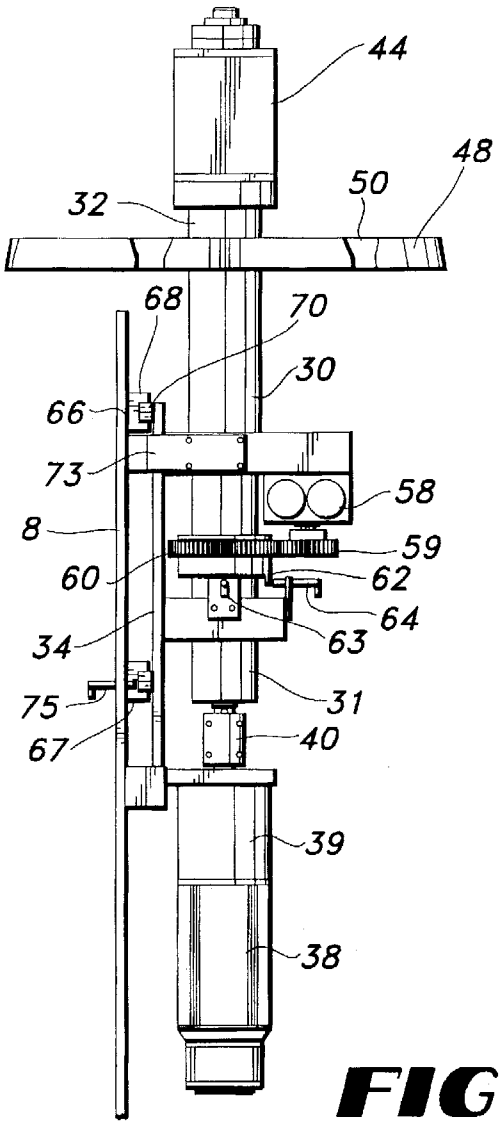
FIG. 3 is an end elevational view of the dual pocket loader wheel assembly along line 3—3 of FIG. 2.

Tubular member 30 is rotated on bearing assemblies 35 and 36 mounted on framework 34 by a rotary actuator 58, as illustrated in FIG. 3. Rotary actuator 58 may be a hydraulic or electric actuator. Here, however, rotary actuator 58 is a pneumatic actuator operated by a control solenoid (not illustrated) operated by a control processor (not illustrated). Rotary actuator 58 is mounted on framework 34 and 13 operably connected to a spur gear 59, spur gear 59 being engaged with a hub gear 60 positioned on the outside periphery of tubular member 30 intermediate its first and second ends, as shown. So constructed, rotary actuator 58, spur gear 59, and hub gear 60 provide a positive drive train for rotating tubular member 30, as well as for rotating drive frame 44, for alternately positioning first pocket loader wheel 46 and second pocket loader wheel 48 adjacent carton transport conveyor 19, respectively.

As shown in FIGS. 2 and 3, an annular proximity flag 62 having a spaced series of projecting tabs is formed as a part of hub gear 60 and extends below the hub gear toward first end 31 of the tubular member. Proximity flag 62 is used for detecting the rotational position of tubular member 30 with respect to packaging machine 7 and carton transport conveyor 19 by a pair of proximity sensors mounted on framework 34, a proximity sensor 63 shown in FIG. 2 and a second proximity sensor 64 shown in FIG. 3. As tubular member 30 is rotated, proximity flag 62 rotates through the same angle of rotation as does tubular member 30, this degree of rotation being detected by proximity sensors 63 and 64 which signal servomotor 38, through the control processor (not illustrated) to stop the rotation of tubular member 30 once the position of pocket loader wheels 46 and 48 has been reversed with respect to carton transport conveyor 19. As described above, proximity flag 62 has a spaced series of "flags" formed as a part thereof extending along its circumference and detected by proximity sensors 63 and 64 for properly positioning pocket loader wheels 46, 48 with respect to the carton transport conveyor.

It is also anticipated, although not illustrated herein, that in lieu of proximity flag 62 and proximity sensors 63 and 64, the control processor (not illustrated) which operates packaging machine 7, as well as dual pocket loader wheel assembly 5, will be equipped to receive digital position signals from an encoder (not illustrated) provided as a part of a servomotor (not illustrated) used in lieu of rotary actuator 58 so that tubular member 30 could be rotated about axis "A" for precision control of the rotation of dual pocket loader wheel assembly 5 with respect to carton transport conveyor 19. This system, however, has the drawback of somewhat greater costs over rotary actuator 58 and proximity flag 62 shown in FIGS. 2 and 3.

Framework 34 is constructed for movement toward and away from carton transport conveyor 19 on frame 8 of the packaging machine as shown in FIGS. 2 and 3. Loader wheel assembly 5 includes a pair of spaced and generally parallel linear bearings 66, 67, mounted on frame 8 and engaged with framework 34 of the loader wheel assembly. This is best shown in FIG. 3, in which a first bearing assembly 66 and a second bearing assembly 67 are shown, each bearing assembly extending along a longitudinal axis (not illustrated) and having an elongate guide block 168 in which a corresponding elongate slide block or rail 170 is received for reciprocal movement within the bearing assemblies toward and away from carton transport conveyor 19 on frame 8 of packaging machine 7.

Framework 34, and thus dual pocket loader assembly 5, is reciprocally moved on bearing assemblies 66 and 67 by a double action cylinder 71 mounted on framework 34. Cylinder 71 may be a hydraulic, or preferably, a pneumatic cylinder. Cylinder 71 has a cylinder rod 72 extending therefrom, the free end of cylinder rod 72 being received in or on bracket 73 formed as a part of frame 8 of packaging machine 7, as illustrated in FIGS. 2 and 3. As cylinder rod 72 is extended, framework 34, and thus tubular member 30, is moved toward carton transport conveyor 19, which positions one of the pocket loader wheels 46, 48 adjacent the carton transport conveyor. When cylinder rod 72 is retracted into cylinder 71, framework 34 is moved on bearing assemblies 66 and 67 toward bracket 73 and thus away from carton transport conveyor 19 for moving the pocket loader wheels 46, 48 away from carton transport conveyor 19 as shown in FIG. 4B.

The linear position of framework 34 with respect to carton transport conveyor 19 is sensed by a pair of proximity sensors mounted on packaging machine frame 8, proximity sensor 75 illustrated in FIG. 3 for the retracted position of cylinder rod 72, and proximity sensor 76 (FIG. 2) for the extended position of cylinder rod 72 which equates to the two positions of pocket loader 46, 48 with respect to carton transport conveyor 19.

As shown in FIGS. 1 and 2, dual pocket loader wheel assembly 5 is supported on frame 8 of packaging machine 7 in inclined fashion so that pocket loader wheels 46, 48 extend over selector wedges 17 and are positioned adjacent carton transport conveyor 19, each selector wedge 17 having a tapered end sized and shaped to permit the pocket loader wheels to be extended thereover and toward carton transport conveyor 19. The angle at which longitudinal axis "A" of tubular member 30 is tilted toward carton transport conveyor 19 may vary dependent on the size of selector belt 15, selector wedges 17, and pocket loader wheels 46, 48, although it is anticipated that tubular member 30 will preferably be angled at approximately 10° toward carton transport conveyor 19. This permits the selector wedges to be thicker at the end thereof which is used to separate the articles (not illustrated) into groups of predetermined sizes on selector belt 15, where needed, and allows the selector wedges to be thinner for working in cooperation with pocket loader wheels 46, 48 for seating the articles within the preformed cartons being moved along the carton transport conveyor.

Thereafter, and in conventional fashion, the filled cartons with the now seated articles therein are moved downstream along the path of travel on carton transport conveyor 19 and passed through a series of glue applicators (not illustrated), whereupon the flaps are pressed into their closed position by compression and discharge section 23, shown in FIG. 1.

OPERATION

The operation of dual pocket loader wheel assembly 5 is illustrated in FIGS. 4A–4D. Starting first with FIG. 4A, dual pocket loader wheel assembly 5 is shown positioned on packaging machine 7 with respect to carton transport conveyor 19. First pocket loader wheel 46 is positioned adjacent the carton transport conveyor and is being rotated in the direction of the path of travel as shown by the directional arrow thereon. In this position tubular member 30 is locked in position by rotary actuator 58 through spur gear 59 and hub gear 60 so that there is little, if no, rotation of tubular member 30 with respect to carton transport conveyor 19.

Figure 4A:
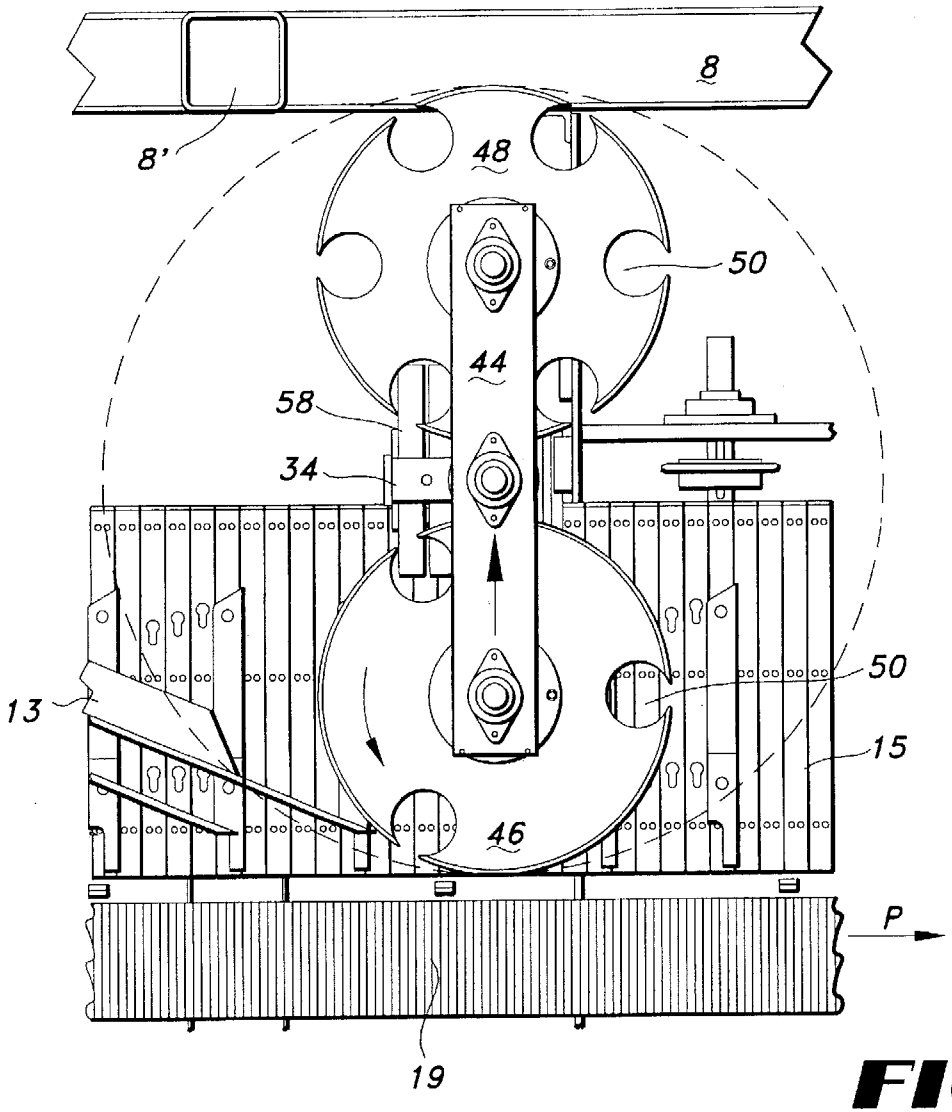
FIGS. 4A–4D are sequential top plan views illustrating the alternate positioning of the pocket loader wheels adjacent the carton transport conveyor of the packaging machine of FIG. 1.
Figure 4B:
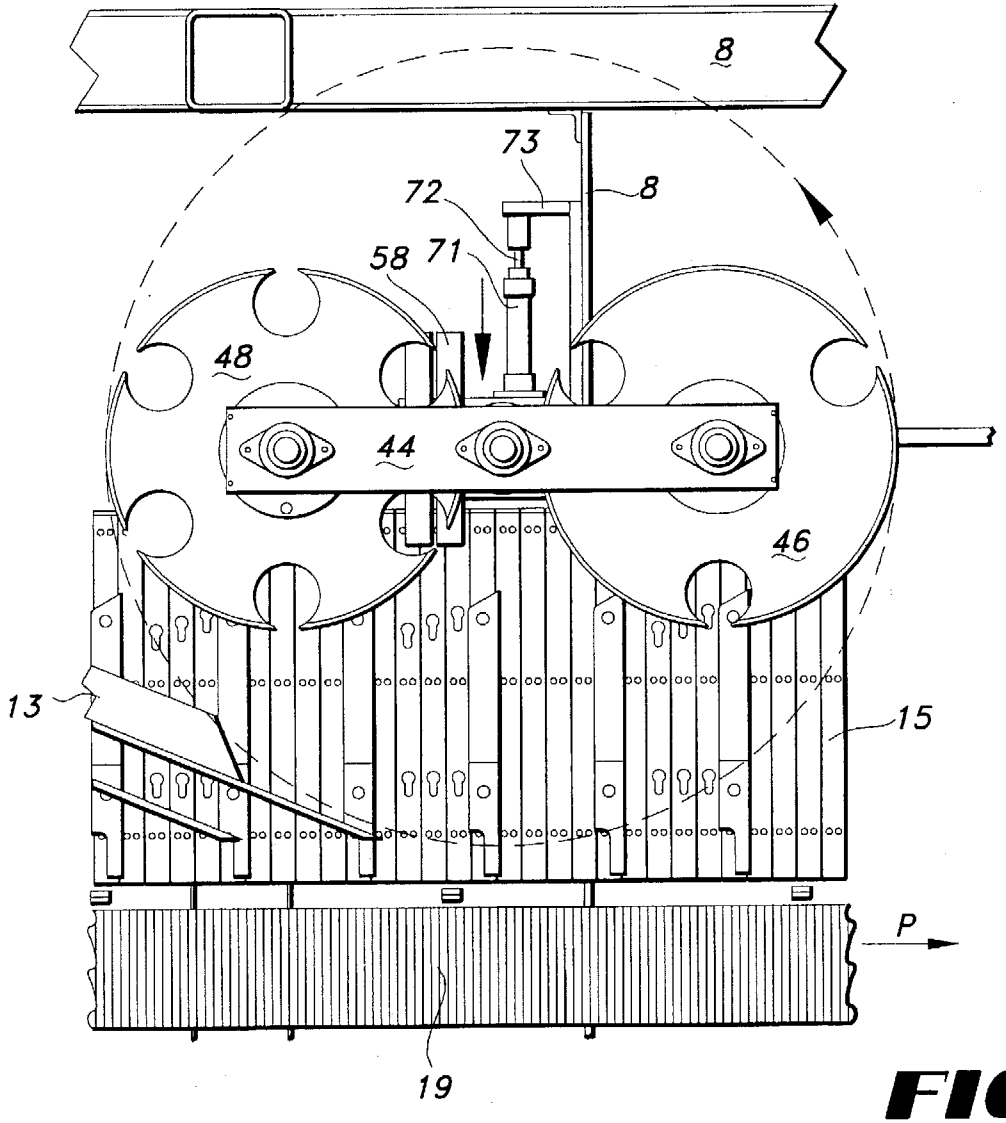

As shown in FIG. 4A, since first pocket loader wheel 46 is being used, the cartons being moved on the carton transport conveyor are on 15 inch centers. Assuming, therefore, that a change in packaging requirements is made, for example, six packs will now be packaged, the lugs which form the pockets of carton transport conveyor 19 are "split" to form 7½ inch pockets, as disclosed more fully in co-pending application Ser. No. 08/118,111, now U.S. Pat. No. 5,546,734 incorporated by reference herein, so the need arises to reverse the position of first pocket loader wheel 46 with second pocket loader wheel 48.

Figure 4C:
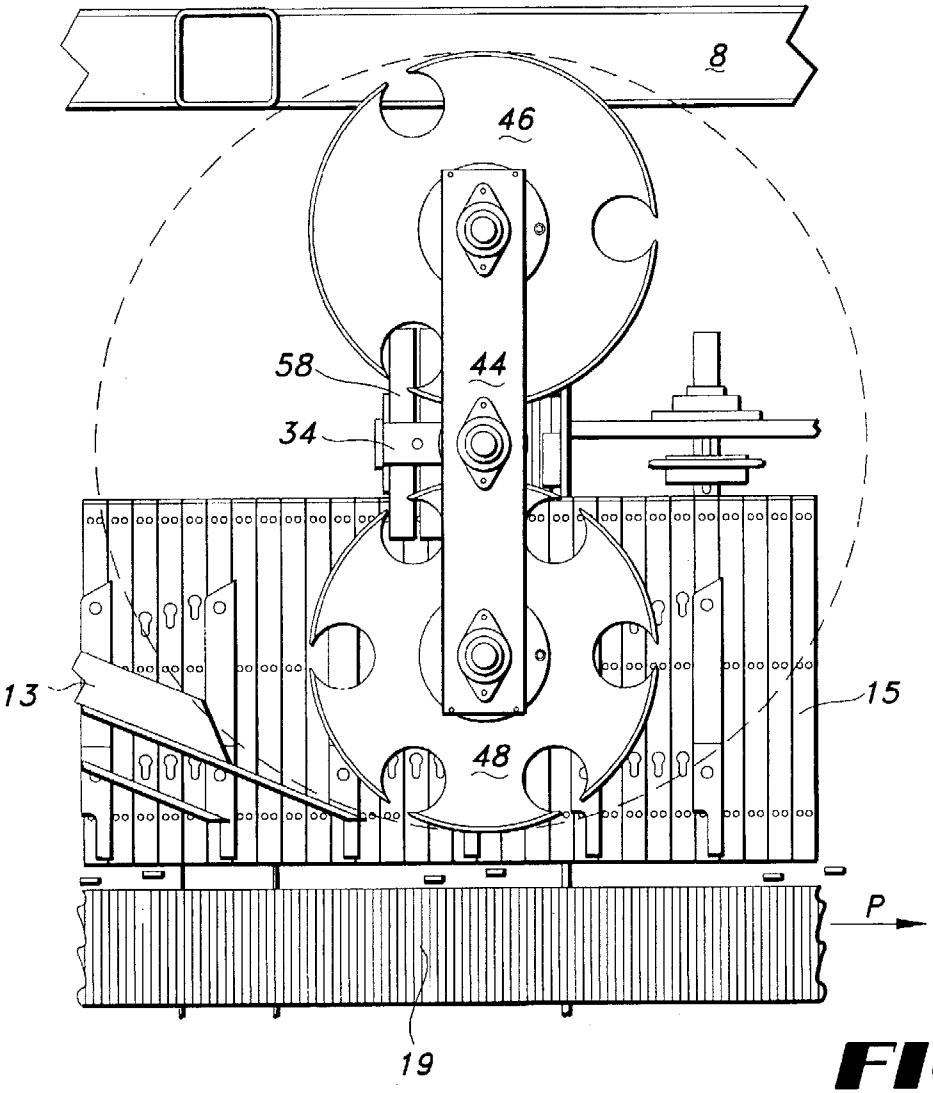
Figure 4D:
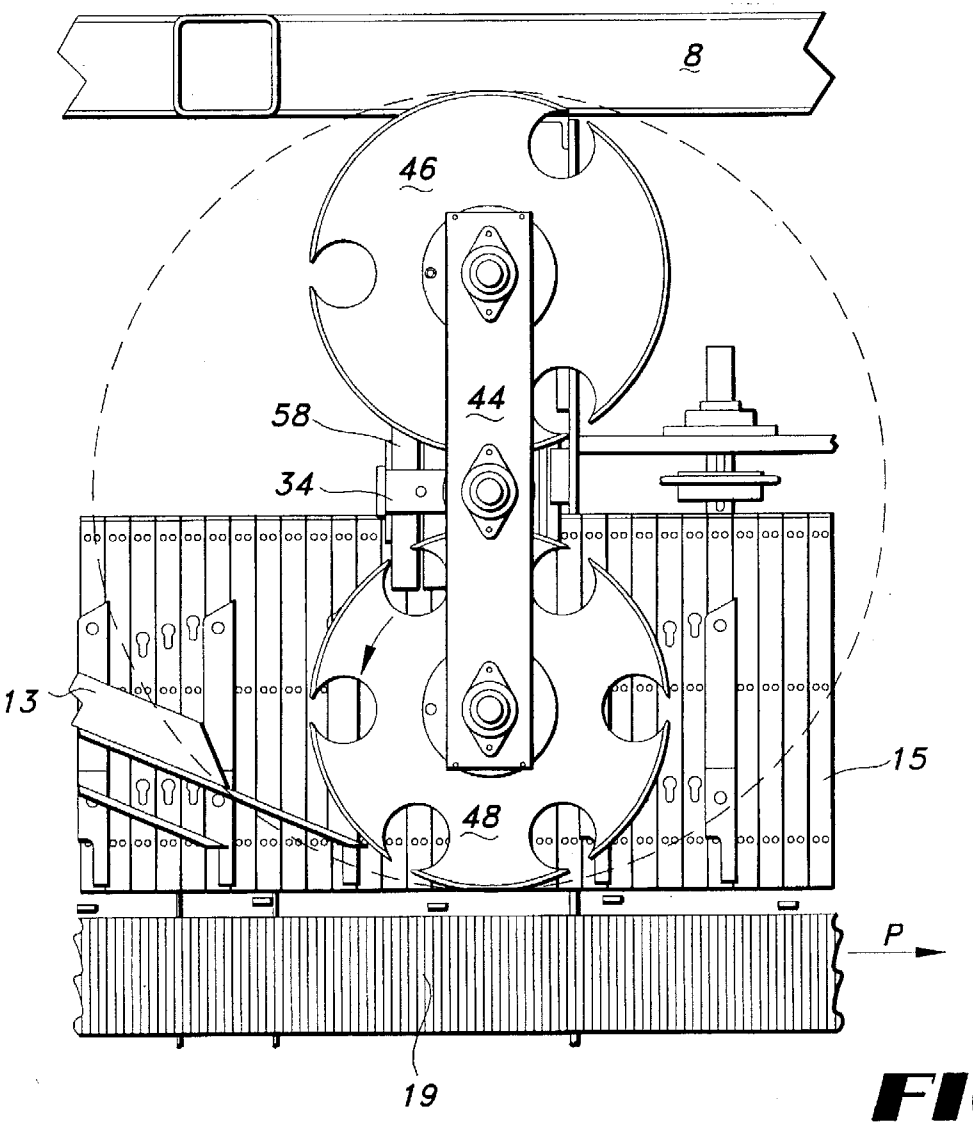

The processes of reversing the position of the dual pocket loader wheels with respect to the carton transport conveyor starts by rotating tubular member 30 in a counterclockwise direction as shown in FIG. 4B. First pocket loader wheel 46 is rotated through an arc of approximately 160°, whereupon double action cylinder 71 is actuated by a control processor (not illustrated) the control processor in turn emitting a control signal to a control solenoid (not illustrated) which controls cylinder 71 so that cylinder rod 72 is retracted to move framework 34 linearly away from the carton transport conveyor. First pocket loader wheel 46 and tubular member 30 are rotated through an arc of an additional 20°, so the position of first pocket loader wheel 46 and second pocket loader wheel 48 have been reversed. Second pocket loader wheel 48 being spaced approximately 3 inches from being adjacent carton transport conveyor 19, as illustrated in FIG. 4C. Thereafter, the control processor emits a control signal to the solenoid which actuates cylinder 71, whereupon cylinder rod 72 is extended to drive framework 34 linearly toward carton transport conveyor 9, framework 34 riding within linear bearing assemblies 166 and 177, to its working position adjacent carton transport conveyor 19 as shown in FIG. 4D.

Tubular member 30 and drive frame 44 are rotated together in counterclockwise direction so that first pocket loader wheel 46 will clear guide rails 13 shown in FIGS. 4A–4D, and cylinder 71 actuated after the drive frame is rotated through an arc of approximately 160° once second pocket loader wheel 48 has cleared frame 8 of the packaging machine, as shown in FIGS. 4A–4D. The drive frame is then rotated through the final 20°, and the framework moved back toward carton transport conveyor 19 by cylinder 71 in order to properly position second pocket loader wheel 48 with respect to the carton transport conveyor.

When reversing the position of second pocket loader wheel 48 with first pocket loader wheel 46 to the configuration shown in FIG. 4A, framework 34 is moved backward on the linear bearing assemblies 66 and 67 by cylinder 71 away from carton transport conveyor 19, and tubular member 30 is rotated in clockwise direction through an arc of approximately 90°, whereupon the control processor then simultaneously rotates tubular member 30 and drive frame 44 through the remainder of the 90° arc, while also moving the framework 34 back toward carton transport conveyor 19 as it is not necessary to clear guide rails 13 when exchanging second pocket loader wheel 48 for first pocket loader wheel 46 adjacent the carton transport conveyor.

After framework 34 has moved on bearing assemblies 66 and 67, cylinder 71 will "lock" the framework in position with respect to carton transport conveyor 19 so that the pocket loader wheels will fully seat the articles being received within the open end (not illustrated) of the cartons (not illustrated) being passed on the cannon transport conveyor adjacent the dual pocket loader wheel assembly. In similar fashion, rotary actuator 58 will "lock" tubular member 30 in position, via spur gear 59 and hub gear 60, so that the drive frame and thus the pocket loader wheels do not rotate out of position with respect to carton transport conveyor 19 during packaging operations.

It is anticipated that servomotor 38 will not rotate drive shaft 42 during that period of time in which tubular member 30 is being rotated about its longitudinal axis while alternately positioning the pocket loader wheels adjacent the carton transport conveyor. However, and in conjunction with the control program for packaging machine 7 stored within the control processor, once the selected pocket loader wheel has been positioned adjacent the carton transport conveyor, the control processor will emit a run control signal to servomotor 38 which will then rotate the selected pocket loader wheel in the direction of the path of travel.

While a preferred embodiment of the invention has been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material or acts for performing the functions in combination with other claimed elements as specifically claimed herein.

I claim:

1. A dual pocket loader wheel assembly for use on a packaging machine, the packaging machine having an infeed end and a spaced discharge end, a carton transport conveyor extending along a path of travel from the infeed end toward the discharge end of the packaging machine, said dual pocket wheel loader assembly comprising:

a) an elongate tubular member extending along a longitudinal axis, said tubular member having a first end and a spaced second end;

b) a framework supported on the packaging machine with respect to the carton transport conveyor, said tubular member being supported for rotation about said longitudinal axis on said framework;

c) a drive frame assembly mounted on the second end of said tubular member, said drive frame assembly supporting a first pocket loader wheel and a spaced second pocket loader wheel, each of said pocket loader wheels being rotatably supported on said drive frame assembly;

d) drive means, mounted on said framework, for rotating each said pocket loader wheel in the direction of the path of travel; and e) means for alternately positioning each said pocket loader wheel adjacent the carton transport conveyor.

2. The dual pocket loader wheel assembly of claim 1, said means for alternately positioning said pocket loader wheels adjacent the carton transport conveyor comprising:

a) means, supported on said framework, for rotating said tubular member about said longitudinal axis; and b) means for moving said framework toward and away from the carton transport conveyor.

3. The dual pocket loader wheel assembly of claim 2, said means for rotating said tubular member about said longitudinal axis comprising a rotary actuator mounted on said framework, said rotary actuator having a spur gear driven by said actuator, and a hub gear positioned on said tubular member intermediate the first end and the second end of the tubular member, said spur gear being engaged with said hub gear for rotating said tubular member about said longitudinal axis.

4. The dual pocket loader wheel assembly of claim 3, further comprising a proximity flag formed as a part of said hub gear, said proximity flag being sized and shaped to rotate with said hub gear as said hub gear rotates said tubular member, said means for rotating said tubular member further comprising a pair of proximity sensors mounted on said framework with respect to said proximity flag for detecting the rotational position of said tubular member.

5. The dual pocket loader wheel assembly of claim 2, wherein said means for rotating said tubular member about said longitudinal axis rotates said tubular member and said drive assembly mounted thereon through an arc of approximately one-hundred and eighty degrees.

6. The dual pocket loader wheel assembly of claim 2, wherein said means for moving said framework toward and away from the carton transport conveyor further comprises means for supporting said framework on the packaging machine for reciprocal movement toward and away from the carton transport conveyor, and a double action pneumatic cylinder mounted on said framework and engaged with the packaging machine, said cylinder being constructed and arranged to reciprocally move said framework on the packaging machine toward and away from the carton transport conveyor.

7. The dual pocket loader wheel assembly of claim 6, said means for supporting said framework on the packaging machine for reciprocal movement toward and away from the carton transport conveyor comprising a pair of spaced guide blocks mounted on the packaging machine, and a spaced pair of slide blocks mounted on said framework, each said slide block being sized and shaped to be received within one each of said guide blocks, respectively.

8. The dual pocket loader wheel assembly of claim 7, further comprising a pair of proximity sensors mounted on the packaging machine for detecting the position of said framework with respect to the carton transport conveyor.

9. The dual pocket loader wheel assembly of claim 7, wherein said framework is moved by said double action pneumatic cylinder through a distance of approximately three inches toward and away from the carton transport conveyor on said guide blocks.

10. The dual pocket loader wheel assembly of claim 1, said drive means for rotating said pocket loader wheels in the direction of the path of travel comprising:

a) a drive motor mounted on the framework at the first end of said tubular member;

b) a drive shaft connected to said drive motor and extending to said drive frame assembly; and c) a belt drive assembly, positioned within said drive frame assembly and engaged with said drive shaft, for rotating each said pocket loader wheel.

11. The dual pocket loader wheel assembly of claim 10, wherein said drive shaft extends from said drive motor along said longitudinal axis within said tubular member.

12. A dual pocket loader wheel assembly for use on a packaging machine comprising:

a) an elongate tubular member extending along a longitudinal axis, said tubular member having a first end and a spaced second end;

b) a framework supported on the packaging machine, said tubular member being supported for rotation about said longitudinal axis on said framework;

c) a drive frame assembly mounted on the second end of said tubular member;

d) a first pocket loader wheel and a spaced second pocket loader wheel, each of said pocket loader wheels being rotatably supported on said drive frame assembly about a first wheel axis and a second wheel axis, respectively, each said loader wheel being supported transversely on said drive frame assembly with respect to said longitudinal axis;

e) drive means, mounted on said framework at the first end of said tubular member, for rotating said first pocket loader wheel about said first wheel axis and for rotating said second pocket loader wheel about said second wheel axis, respectively; and f) means, supported on said framework, for rotating said tubular member about said longitudinal axis.

* * * * *